US005979645A

United States Patent [19]

Holley, Jr.

[11] Patent Number: 5,979,645

[45] Date of Patent: Nov. 9, 1999

[54] BASKET-STYLE ARTICLE CARRIER WITH NON-STEPPED SIDE WALLS

[75] Inventor: John M. Holley, Jr., Lawrenceville, Ga.

[73] Assignee: The Mead Corporation, Dayton, Ohio

[21] Appl. No.: 09/093,839

[22] Filed: May 29, 1998

[51] Int. Cl.[6] ..... B65D 75/00

[52] U.S. Cl. ..... 206/175; 206/427

[58] Field of Search ..... 206/170, 175, 206/181, 182, 184, 186, 193, 427, 431

[56] References Cited

U.S. PATENT DOCUMENTS

| | | | |
|---|---|---|---|
| 3,981,397 | 9/1976 | Arneson | 206/186 |
| 4,319,682 | 3/1982 | Wright et al. | 206/180 |
| 4,782,944 | 11/1988 | Engdahl, Jr. | 206/185 |
| 4,927,009 | 5/1990 | Stout . | |
| 5,029,698 | 7/1991 | Stout . | |
| 5,040,672 | 8/1991 | DeMaio et al. . | |
| 5,538,131 | 7/1996 | Harrelson | 206/162 |

*Primary Examiner*—Paul T. Sewell
*Assistant Examiner*—Nhan T. Lam
*Attorney, Agent, or Firm*—Michael V. Drew

[57] ABSTRACT

A basket-style article carrier (10) with straight, non-stepped side walls (26, 72) and end walls (52/86, 112/122) wherein partition portions containing cell-forming partition straps **(34*a*, 34*b*, 64*a*, 64*b*) are struck from a multiple-ply handle structure and are adhered to a central support member (104) which is also struck from the multiple-ply handle structure. The multiple-ply handle structure which includes handle panels (44, 46, 94, 96) lie within the perimeter of the side wall and end structure panels of the blank (16)** for forming the carrier.

6 Claims, 4 Drawing Sheets

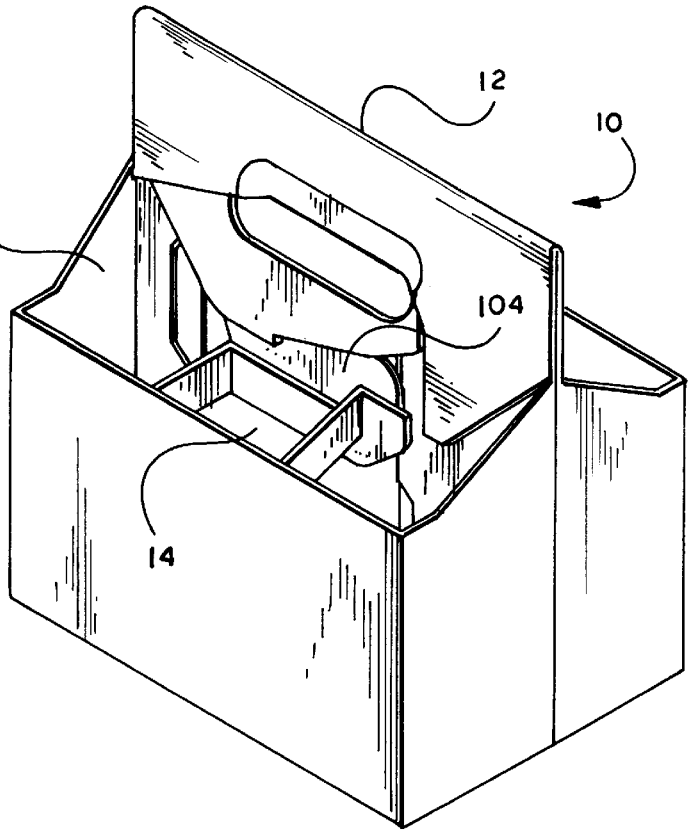
Fig. 1
Fig. 5
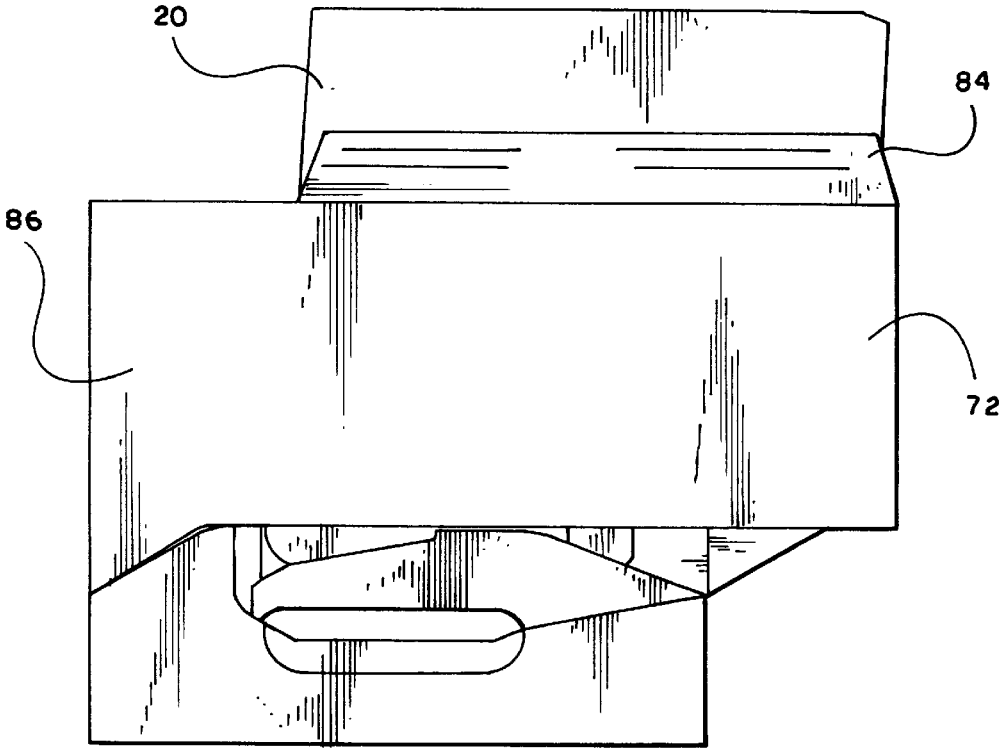

BASKET-STYLE ARTICLE CARRIER WITH NON-STEPPED SIDE WALLS

FIELD OF THE INVENTION

The present invention relates generally to basket-style article carriers, and, more particularly, to a basket-style article carrier with straight, non-stepped side walls.

BACKGROUND OF THE INVENTION

A basket-style carrier generally has end walls, sidewalls and transverse partition straps together forming a plurality of cells for receiving articles such as beverage containers. Some carriers have stepped sidewalls forming cells of different heights. In a basket carrier with stepped side walls the transverse straps which form cells are normally struck from the side and end wall portions that are "stepped down" from a central cell. Often, it is desirable to have a basket carrier with straight, non-stepped side walls. Usually, in order to create a basket-carrier having non-stepped, straight side walls additional carrier material must be provided in order to form the transverse straps which form the cells. U.S. Pat. Nos. 4,927,009, 5,029,698, and 5,040,672, all owned by the Mead Corporation, also the owner of the present invention, relate to basket-style carriers having straight, non-stepped side walls.

SUMMARY OF THE INVENTION

The present invention provides a basket-style article carrier with straight, non-stepped side walls and end walls wherein partition portions containing cell-forming partition straps are struck from at least one of the outer plies and inner plies of a multiple-ply handle and are adhered to a central support member which is struck from an inner ply handle panel of the multiple-ply handle. The handle panels lie within the perimeter of the side wall and end structure panels of the blank for forming the carrier.

Other advantages and objects of the present invention will be apparent from the following description, the accompanying drawings, and the appended claims.

BRIEF DESCRIPTION OF THE DRAWINGS

FIG. 1 is a perspective view of a preferred embodiment of a set-up carrier with straight side panels and partition straps according to the present invention.

FIGS. 3–5 illustrate stages through which the blank of FIG. 2 is manipulated to form the carrier of FIG. 1.

DETAILED DESCRIPTION OF THE PREFERRED EMBODIMENT

Figure 2:
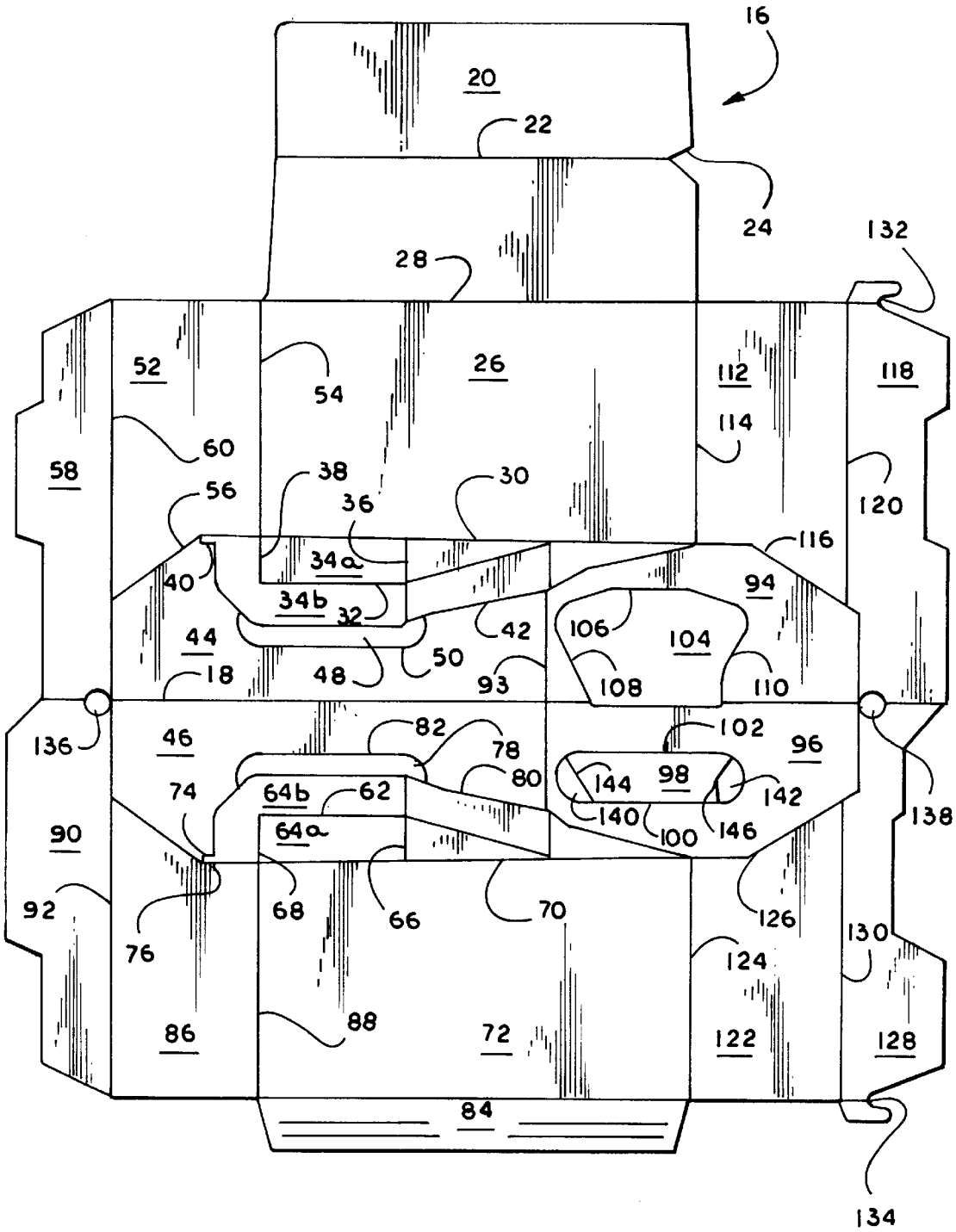
FIG. 2 is a plan view of a blank from which the carrier of FIG. 1 is formed.
Figure 3:
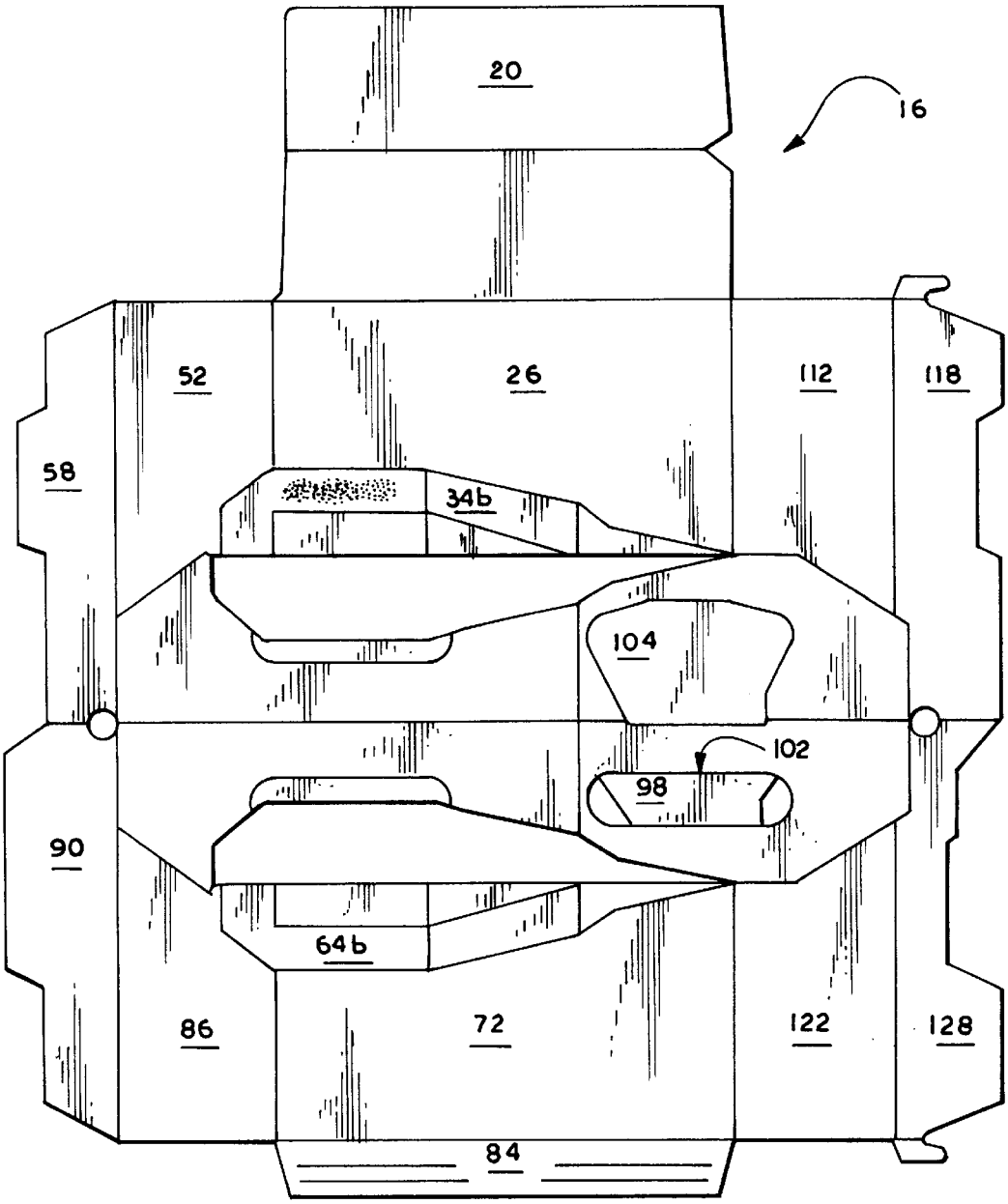

Throughout the drawings the same reference numerals are used to denote the same features of the preferred embodiment of the invention.

Referring first to FIGS. 1 and 2 simultaneously, a basket-style article carrier 10 in accordance with a preferred embodiment of the invention has a handle 12 and a plurality of cells 14 for carrying articles, such as containers of beverage. The side walls and end walls of the carrier 10 are non-stepped.

The article carrier 10 is formed from a blank 16 in which the handle and partition elements lie within boundaries of the blank generally formed by side wall, end wall and riser panels thus minimizing scrap material. The blank 16 has a central horizontal fold line 18 that divides the blank into what are referred to as first and second segments. These two segments are similar to one another. A bottom panel 20 is located in the first segment. The bottom panel 20 has first and second opposed side edges, first and second opposed end edges and a horizontal fold line 22 extending between the end edges. Horizontal fold line 22 divides the bottom panel 20 into two sections that fold flat along the fold line 22 against one another when the carrier 10 is folded for storage or shipping. The second end edge of the bottom panel 20 provides a notch 24 forming a female locking member.

The first sidewall 26 in the first segment has first and second side edges and first and second end edges and is joined to the second side of the bottom panel 20 along a horizontal fold line 28 at the first side of the first sidewall 26. When assembled, the first sidewall 26 stands generally upright from the bottom panel 20 along the fold line 28.

The handle structure of the erected carrier 10 is multiple-ply. The partition panels are struck from the handle structure. In the preferred embodiment illustrated the outer ply of each side of the handle of the erected carrier is formed by panels which for convenience of reference are referred to as top (or upper) handle panels 44, 46. The inner plies of the multiple-ply handle of the erected carrier 10 are provided by panels which for convenience of reference will be referred to as bottom (or lower) handle panels 94, 96. The greater portions of the partition panels are struck from the top (upper) handle panel assembly. These portions of the partition panels lie adjacent the remaining parts of the upper handle panels along respective cut lines 42, 80 in the blank 16. The central horizontal fold line 18 divides the upper handle panel assembly into first and second upper handle panels 44, 46 that mirror one another across the central horizontal fold line 18. A hand hole flap 48 is positioned between the first upper handle panel 44 and transverse partition panel 34*b*. The flap 48 is adjacent panel 34*b* lying along cut line 42 and is attached along fold line 50 to the first upper handle panel 44.

A first partition panel is located in the first segment of the blank 16 and is joined to the second side of the first sidewall 26 along a horizontal fold line 30. The first partition panel is divided along cut line 32 into two portions 34*a*, 34*b* that are transverse partition straps for forming the container cells in the set-up carrier 10. Panel 34*a* is a trapezoid with a vertical fold line 36 dividing panel 34*a* into a rectangular portion and a triangular portion. Panel 34*a* is connected to panel 34*b* along vertical fold line 38. Panel 34*b* joins first sidewall 26 along fold line 30. The outer periphery follows the same basic contour as the inner periphery but is spaced therefrom and has a chamfered corner opposite the intersection of vertical fold line 38 and cut line 32. Panel 34*b* has a nib 40 that points away from vertical fold line 38 and is positioned along a horizontal portion of cut line 56. Nib 40 connects the partition panel to the handle panel 44. The narrowness of the nib 40 connecting member allows the partition panel to be easily twisted over and displaced 180 degrees into a position wherein the partition straps 34*a*, 34*b* form cells in the erected carrier.

A first end panel 52 is located in the first segment of the blank 16 and is joined along vertical fold line 54 to the first end of the first sidewall panel 26. The first end panel 52 abuts the first upper handle panel 44 along cut line 56. Cut line 56 is also the cut line between the rectangular portion of partition panel 34*a* and the first sidewall panel 26. A first riser panel 58 in the first segment is joined along vertical fold line 60 to the first end panel 52 and the first upper handle panel 44.

A second partition panel located in the second segment of the blank 16 mirrors the first partition panel across the central horizontal fold line 18. The second partition panel is divided along cut line 62 into two portions 64*a*, 64*b* that are transverse partition straps that form the container cells in the set-up carrier 10. Panel 64*a* is a trapezoid with a vertical fold line 66 dividing panel 64*a* into a rectangular portion and a triangular portion. Panel 64*a* is connected to panel 64*b* along vertical fold line 68. Panel 64*b* joins second sidewall 72 along fold line 70. The outer periphery follows the same basic contour as the inner periphery but is spaced therefrom and has a chamfered corner opposite the intersection of vertical fold line 68 and cut line 62. Panel 64*b* has a nib 74 that points away from vertical fold line 68 and is positioned along a horizontal portion of cut line 76. As with nib 40, nib 74 connects the partition panel (with straps 64*a*, 64*b*) to its associated handle panel 46. Again, the narrowness of the nib 74 connecting member allows the partition panel to be easily twisted over and displaced 180 degrees into a position wherein the partition straps 64*a*, 64*b* form cells in the erected carrier.

A second hand hole flap 78 is positioned between the second upper handle panel 46 and transverse partition panel 64*b* mirroring hand hole flap 48. The second upper handle panel assembly is adjacent the partition panel along cut line 80 which follows the outer peripheral contour of panel 64*b*. The flap 78 is adjacent panel 64*b* lying along cut line 80 and is attached along fold line 82 to the second upper handle panel 44.

The second sidewall 72 mirrors the first sidewall 26. It is attached along fold line 70 to the transverse partition panel and lies adjacent the transverse partition panel along cut line 76. A glue flap 84 extends from the second side edge of the second sidewall panel 72.

A second end panel 86 mirrors the first end panel 52. It is attached to the second sidewall 72 along vertical fold line 88 and is adjacent lower handle panel 46 along cut line 76. It also borders partition panel 64*b* along cut line 76.

A second riser panel 90 is connected along vertical fold line 92 to the second end panel 86. It is also attached along central horizontal fold line 18 to the first riser panel 58 and mirrors the first riser panel 58 across the central horizontal fold line 18.

As mentioned above, the inner plies of the multiple-ply handle of the erected carrier 10 are provided by panels which for convenience of reference are referred to as bottom (or lower) handle panels 94, 96. The bottom (lower) handle panel assembly lies adjacent the partition panel along cut line 42 which follows the outer peripheral contour of panel 34*b*, and adjacent the upper handle panel assembly along vertical cut line 93. The central horizontal fold line 18 divides the lower handle panel assembly into first and second lower handle panels 94, 96. A hand hole flap 98 in the second lower handle panel 96 lies along cut line 100 and is attached along fold line 102. A central support panel 104 is attached to the first lower handle panel 94 along fold line 106 and lies along cut lines 108 and 110 and is also cut along the central horizontal fold line 18. In the erected carrier central support panel (or flap) 104 is folded 180 degrees along fold line 106 into flat-face relationship with handle panel 94. In this folded condition support panel/flap 104 extends a distance sufficient for enabling the transverse partition straps 34*a*, 34*b*, 64*a*, 64*b* to be attached to the support panel 104 while maintaining the partition straps in an essentially horizontal position. When the carrier is set up hand hole flap 98 is folded along fold line 102 into flat-face relationship with the handle panel 96 to which it is attached. Thus, when the adjoined inner (lower) handle panels 94, 96 are folded along fold line 18 into flat-face relationship with one another, hand hole flap 98 fills in most of the upper portion of the space created when the central support panel 104 is folded out of the position and plane from which it is struck. This adds to the integrity of the handle element in the erected carrier by maintaining the four-ply structure of the handle at its most stressed part. The lower portion (that is, the portion farthest from central fold line 18) of the space created when the central support panel 104 is folded out of the position from which it is struck forms a hand-hole area in handle panel 94.

A third end panel 112 is located in the first segment and is joined along vertical fold line 114 to the second end of the first sidewall panel 26. The third end panel 112 abuts the first lower handle panel 94 along cut line 116. Cut line 116 is also the cut line between the rectangular portion of partition panel 64*a* and the first sidewall panel 26. A third riser panel 118 in the first segment is joined along vertical fold line 120 to the third end panel 112 and the first lower handle panel 94.

A fourth end panel 122 mirrors the third end panel 112. It is attached to the second sidewall 72 along vertical fold line 124 and is adjacent lower handle panel 96 along cut line 126. It also borders partition panel 64*b* along cut line 126.

A fourth riser panel 128 is connected along vertical fold line 130 to the fourth end panel 122. It is also attached along central horizontal fold line 18 to the third riser panel 118 and mirrors the third riser panel 118 across the central horizontal fold line 18. The third and fourth riser panels 118, 128 are joined to one another along central horizontal fold line 18, and the other sides of riser panels 118, 128 contain notches 132, 134 for forming a male locking member in the set up carrier.

Essentially, the blank 16 has only four small cut-outs 136, 138, 140, 142 that result in scrapped material. There is minimal waste of carrier material. The circular cut-outs 136, 138 facilitate folding of the carton without bunching. Cut-out 140 is located at one end of hand hole flap 98, and cut-out 142 is located at the other end of hand hole flap 98. These hand-hole cut-outs 140, 142 help facilitate separation of the unattached portions of hand-hole flap 98 from the handle panel 96. Cut-out 140 lies along arcuate cut line 100 and straight cut line 144 at one end of flap 98. Cut-out 142 lies along arcuate cut line 100 and cut line 146 at one end of flap 98. The cut lines 140, 142 at the transverse edges of the hand-hole flap 98 correspond to the configuration of the portion partition panel cut lines 108, 110 which lie closest to the blank's central fold line. Because of this arrangement, when the hand-hole flap 98 of the handle panel 96 is folded into flat-face relation with the handle panel 96 and the hand-hole flap 98 lies disposed within the aperture of the opposing handle panel 94 created by removal of the central support panel 104, one edge 144 of the hand-hole flap 98 lies adjacent and follows the contour of cut line 108 of handle panel 94 and the other edge 146 of hand-hole flap 98 lies adjacent and follows the contour of cut line 110 of handle panel 94.

Setting-up (or erection) of the carrier 10 from the blank 16 is now described by referring to FIGS. 1–5. As will be described in greater detail below the handle panels, end panels, riser panels, transverse partition portions (including transverse partition straps 34*a*/34*b*, 64*a*/64*b*), central support panel 104, and the hand hole flap 98 are folded and glued to produce the erected carrier 10 shown in FIG. 1. The erected, set-up carrier 10 has a multiple-ply handle wherein lower handle panels 94, 96 form the inner plies and upper handle panels 44, 46 form the outer plies of the handle, with the central support member 104 depending from the multiple-ply handle, with hand hole flap 98 positioned within the upper portion of the space in handle panel 94 from which the central support panel was struck, and with one end of each transverse partition panel adhered to the central support panel 104 and the opposing end of each transverse partition panel foldably joined to a respective side wall panel 26, 72 along its respective fold lines 30, 70.

The invention contemplates that the sequence of folding and gluing the various parts of the blank 16 may vary. In a preferred embodiment, the transverse partition panels (containing transverse partition straps (34*a*/34*b*, 64*a*/64*b*) are folded out of the respective handle panels 44, 46. The first partition panel is folded along fold line 30 into flat-face relationship with the first sidewall panel 26. Similarly, the second partition panel is folded along fold line 70 into flat-face relationship with the second sidewall panel 72. Glue is applied to selected areas of the upper handle assembly panels 44, 46 for adhering those panels together. As the partition straps (34*a*/34*b*, 64*a*/64*b*) are manipulated into position for gluing to the central support panel 104, the nib 40, 74 members keep the partition panels attached to the handle panels 44, 46 so that proper alignment may be achieved. The partition panels are folded along respective fold lines 30, 70 into flat-face relationship with respective first and second side wall panels 26, 72.

Assembly continues by lifting the lower handle assembly and folding up the central support panel 104. The lower handle panel assembly is then brought over and laid on the glued area of the upper handle panel assembly so that the lower handle panel assembly nests in the upper handle panel assembly. At the same time, the bottom portion of riser panel 118 is brought into contact with the glued area of lower handle panel 94, a top portion of riser panel 128 is brought into contact with the glued area of lower handle panel 96, and the central support panel 104 is positioned on the glued area of transverse partition strap 34*b*. Next, the riser panels 58, 90 are respectively brought into contact with the glued areas of upper handle panels 44, 46. This construction is illustrated in FIG. 4.

Figure 4:
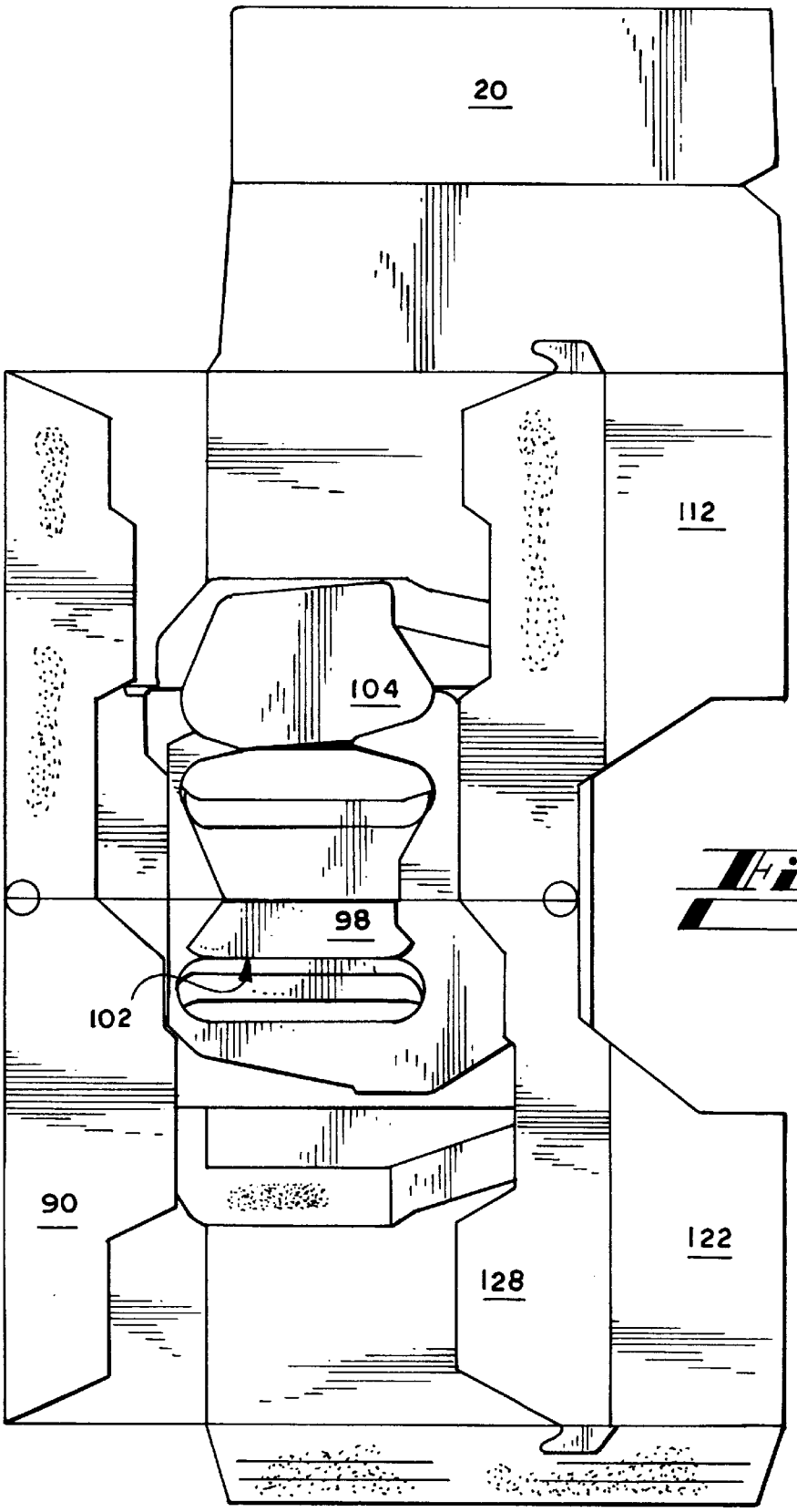

At the stage of assembly illustrated in FIG. 4, glue is applied to transverse partition strap 64*b*, glue flap 84, one or both of riser panels 58 and 90, and to one or both of riser panels 118 and 128. After the glue is applied, the first portion of bottom panel 20 is folded onto the second portion of bottom panel 20 by folding along fold line 22. The assembly is completed by folding the second segment containing second sidewall 72 onto the first segment containing first sidewall 26 along the central horizontal fold line 18. Folding along the central horizontal fold line 18 brings the glued surfaces of riser panels 58 and 90 together and the glued surfaces of riser panels 118 and 128 together, and brings central support member 104 into contact with the glue laden surface of transverse partition strap 64*b*. The final step is bringing glue flap 84 into contact with the bottom panel 26 yielding the flattened carton illustrated in FIG. 5.

In the assembled carton the central support panel 104 is foldably attached to the lower handle panel and sandwiched between the two plies of the folded lower handle panel. The transverse partition straps are connected to the sidewalls and central support panel. The handle assembly thus supports the central support panel and transverse partition straps that are connected to the central support panel. The handle structure also supports the riser panels that are attached to it. Instead of discarding a cut out from the hand hole in the handle, it is folded and used as a central support panel. Smaller riser panels are able to be used because they are not needed to support the transverse partition straps. The hand hole panel that could otherwise constitute waste is used as a central support panel for the transverse partition straps. Because the central support panel is sandwiched between the handle plies, maximum support is achieved while using less paper Double support of the central support panel is achieved by the folded attachment to the lower handle panel and by gluing it to the handle panels.

While the invention has been described with particular reference to a basket carrier for carrying beverage bottles, it is apparent that the carrier is suitable for other containers. As is evident from the foregoing description, certain aspects of the invention are not limited to the particular details of the examples illustrated, and it is therefore contemplated that other modifications and applications will occur to those skilled in the art. For example, the carrier can be assembled from the blank using a different sequence of erecting steps than those described. As a further example of variations contemplated by the invention, it is noted that partition panels in the preferred embodiment illustrated are struck from both upper handle panels and inner handle panels. However, the invention is also practiced whereby the partition panels are struck from only the upper handle panels.

Accordingly, it is intended that the claims shall cover all such modifications and applications as do not depart from the true spirit and scope of the invention.

What is claimed is:

1. A blank for forming an article carrier, the blank comprising:

opposing side wall panels;

opposing end structure panels foldably adjoining said opposing side wall panels, said opposing end structure panels including end wall panels;

at least one bottom panel foldably adjoining one of said side wall panels and end closure structure panels for forming a bottom wall in the erected carrier;

handle structure including inner-ply handle panels and outer-ply handle panels, said handle structure disposed within a perimeter defined by said opposing side wall panels and said opposing end structure panels, said inner-ply handle panels and said outer-ply handle panels including respective hand hole apertures, such that when said inner-ply handle panels and outer-ply handle panels are joined in flat-face condition with one another in the erected carrier said hand hole apertures are aligned for gripping the carrier;

central support structure including at least one central support panel struck from said handle structure and foldably adjoined thereto such that when the carrier is erected said central support panel is foldable to a position depending from said handle structure;

partition panels adjacent said inner-ply handle panels and said outer-ply handle panels, each said partition panel having a first end foldably adjoined to one of said opposing side wall panels and a second end adjoined to said outer-ply handle panel, each of said partition panels including at least one partition strap for forming a cell when the carrier is erected from the blank, said first end of each of said partition panels is foldable to a flat-face contacting position with an adjoining one of said side wall panels wherein it is affixable and a segment of each of said partition panels is affixable to said central support member such that said at least one partition strap forms article-receiving cells in an interior of the carrier when the carrier is erected.

2. The blank of claim 1, wherein said at least one central support panel is struck from at least one of said inner-ply handle panels and depends therefrom in the erected carrier.

3. The blank of claim 2, wherein said at least one central support panel is struck from one of said inner-ply handle panels and a hand-hole flap is struck from an other of said inner-ply handle panels such that in the erected carrier the central support panel is folded out of the plane of said one of said inner-ply handle panels into flat-face relation therewith wherein when said one of said inner-ply handle panels and said other of said inner-ply handle panels are placed in face-contacting relationship with respect to one another said hand-hole flap lies substantially within the plane of said one of said inner-ply handle panels within an aperture from which said central support member is struck and removed.

4. The blank of claim 3, wherein a first configuration of first transverse edges of said hand-hole flap correspond to a second configuration of second transverse edges of said aperture.

5. The blank of claim 1, wherein said partition panels are struck from said handle structure.

6. The blank of claim 1, wherein said second end of each said partition panel is adjoined to said outer handle panel by a nib member.

* * * * *